US007438465B2

(12) United States Patent
Bitterli et al.

(10) Patent No.: US 7,438,465 B2
(45) Date of Patent: Oct. 21, 2008

(54) ASSEMBLY ELEMENT INCLUDING TWO SUPERPOSED STRIP SHAPED ELASTIC STRUCTURES AND TIMEPIECE FITTED WITH THE SAME

(75) Inventors: Roland Bitterli, Neuchâtel (CH); Wilfried Noell, Neuchâtel (CH); Fabien Blondeau, Le Landeron (CH); Lionel Paratte, Neuchâtel (CH); Toralf Scharf, Neuchâtel (CH); Pierre-André Meister, Bienne (CH); André Zanetta, Neuchâtel (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 11/937,738

(22) Filed: Nov. 9, 2007

(65) Prior Publication Data

US 2008/0113154 A1 May 15, 2008

(30) Foreign Application Priority Data

Nov. 9, 2006 (EP) ..... 06123784

(51) Int. Cl.
*G04B 29/00* (2006.01)
*G04B 31/00* (2006.01)
*F16H 49/00* (2006.01)

(52) U.S. Cl. ..... 368/322; 368/324; 74/640

(58) Field of Classification Search ..... 368/80, 368/160, 161, 168, 169, 177, 322–236; 74/640, 74/162, 179; 464/97–100
See application file for complete search history.

(56) References Cited

U.S. PATENT DOCUMENTS 0,185,272 A 12/1876 Weston
0,267,824 A 11/1882 Bell
1,645,510 A * 10/1927 Wood ..... 464/98
3,306,027 A * 2/1967 Schneider ..... 368/326
3,922,041 A * 11/1975 Quaile et al. ..... 368/324
4,127,928 A 12/1978 Green
4,358,166 A * 11/1982 Antoine ..... 384/215
6,453,772 B1 9/2002 Moskob
2003/0007706 A1 1/2003 Suh et al.

FOREIGN PATENT DOCUMENTS

EP 1659460 A1 5/2006
EP 1655642 10/2006
EP 1708045 10/2006
FR 2006825 1/1970

OTHER PUBLICATIONS

European Search Report issued in corresponding application No. EP 06 12 3784. completed Aug. 6, 2007.
Office Action issued in related co-pending U.S. Appl. No. 11/937,696, dated May 15, 2008.
Office Action issued in related co-pending U.S. Appl. No. 11/937,789, dated Jun. 11, 2008.

* cited by examiner

*Primary Examiner*—Vit W Miska
(74) *Attorney, Agent, or Firm*—Griffin & Szipl, P.C.

(57) ABSTRACT

Assembly element (18) made in a plate of brittle material, including an aperture (32) provided for the axial insertion of an arbour (26), the inner wall (33) of the aperture (32) including elastic structures (34), which are etched into the plate to grip the arbour (26) radially. Each elastic structure (34) includes a first rectilinear elastic strip ($L_1$) which extends along a tangential direction relative to the arbour (26). According to the invention, each elastic structure (34) is formed by a radial stack of several parallel elastic strips.

14 Claims, 4 Drawing Sheets

ASSEMBLY ELEMENT INCLUDING TWO SUPERPOSED STRIP SHAPED ELASTIC STRUCTURES AND TIMEPIECE FITTED WITH THE SAME

This application claims priority from European Patent Application No. 06123784.8 filed 9 Nov. 2006, the entire disclosure of which is incorporated herein by reference.

BACKGROUND OF THE INVENTION

The invention concerns an assembly element and a timepiece comprising the same.

The invention concerns more specifically an assembly element made in a plate of brittle material such as silicon, particularly for a timepiece, including an aperture provided for the axial insertion of an arbour, the inner wall of the aperture including elastic structures which are etched in the plate and which each comprise at least one support surface for gripping or squeezing the arbour radially in order to secure the assembly element relative to the arbour, wherein each elastic structure includes a first rectilinear elastic strip which extends along a tangential direction relative to the arbour, the support surface being arranged on the inner face of the first elastic strip.

Generally, in timepieces, the assembly elements such as the timepiece hands and the toothed wheels are secured by being driven into their rotating arbour, i.e. a hollow cylinder is forced onto a pin whose diameter is slightly greater than the inner diameter of the cylinder. The elastic and plastic properties of the material employed, generally a metal, are used for driving in said elements. For components made of a brittle material such as silicon, which does not have a usable plastic range, it is not possible to drive a hollow cylinder onto a conventional rotating arbour like those used in mechanical watchmaking, with a diameter tolerance of the order of +/−5 microns.

Moreover, the solution for securing an assembly element such as a hand must provide sufficient force to hold the element in place in the event of shocks. The force necessary for a conventional timepiece hand is, for example, of the order of one Newton.

In order to overcome these problems, it has already been proposed to make, in an assembly element such as a silicon balance spring collet, flexible strip shaped elastic structures arranged on the periphery of the aperture, so as to secure the collet onto an arbour by a driving in type arrangement, using the elastic deformation of the strips to grip the arbour and retain the collet on the arbour. An example of this type of securing method is disclosed in particular in EP Patent No. 1 655 642.

SUMMARY OF THE INVENTION

It is an object of the invention to provide improvements to this solution, particularly to allow the use of this assembly element as a rotating element in a timepiece mechanism, in particular as a timepiece hand.

Thus, the invention proposes an assembly element of the type described previously, characterized in that each elastic structure is formed by a radial stack of several parallel elastic strips, each elastic strip being separated radially from the adjacent elastic strip by a rectilinear separator hole in two parts, the two pats of the separator hole being separated by a bridge of material that connects the two adjacent elastic strips and which is substantially radially aligned with the support surface, and in that the last elastic strip of the stack, which is located on the opposite side to the first strip, is separated radially from the rest of the plate by a hole in a single part, called a clearance hole, which defines a radial clearance space for the elastic structure.

The assembly element according to the invention improves the gripping force against the arbour, to allow better distribution of the stress linked to the elastic deformation in the material forming the assembly element, and to allow better control of the gripping force obtained on the arbour. In particular, the return forces of each elastic strip of a stack are added together while maintaining the lowest possible level of stiffness for each elastic strip. Significant flexion of the elastic structure is obtained, in particular on the support surface, without departing from the elastic range of the material. Thus, the elastic structures according to the invention offer sufficiently large radial clearance, after their elastic deformation, to compensate for the manufacturing tolerances applied to the diameter of an arbour like those used for driving hands in timepieces.

Moreover, the elastic structures according to the invention optimise the volume available in the assembly element for performing the gripping and securing function.

According to other features of the invention:

- in each elastic structure, the length of the elastic strips decreases gradually from the first elastic strip to the last elastic strip of the stack;
- the radial thickness of each elastic strip is substantially constant over its entire length, and, in each elastic structure, the radial thickness of the elastic strips decreases gradually from the first elastic strip to the last elastic strip of the stack;
- the radial thickness of the separator holes is substantially constant for each separator hole and substantially constant from one separator hole to the next;
- the minimum radial thickness of the clearance hole is greater than or equal to the radial thickness of the separator holes;
- the profile of each of the ends of the each separator hole is rounded;
- the support surface of the first elastic strip includes discrete raised elements which increase the friction between the arbour and the support surface;
- the inner wall of the aperture includes at least three elastic structures which are regularly distributed around the arbour;
- the inner wall of the aperture is formed by two elastic structures and by a fixed support surface, the first elastic strips of the two elastic structures defining between them a determined angle, and the first elastic strip of the two elastic structures being joined to each other at one of the fixed ends thereof;
- the contour of the inner wall of the aperture has the overall shape of an isosceles triangle, and the fixed support surface forms the base of the isosceles triangle;
- the fixed support surface is arranged at the free end of a cut out portion projecting inside the aperture;
- the assembly element is formed by a rotating element fixedly mounted in rotation on the arbour; and
- the assembly element is formed by a timepiece hand.

The invention also proposes a timepiece characterized in that it includes at least one assembly element according to any of the preceding features.

BRIEF DESCRIPTION OF THE DRAWINGS

Other features and advantages of the present invention will appear more clearly upon reading the following detailed description, made with reference to the annexed drawings, given by way of non limiting example, in which.

DESCRIPTION OF THE PREFERRED EMBODIMENTS

Figure 1:
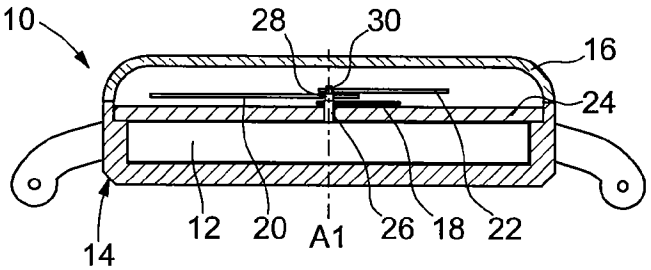
FIG. 1 is an axial cross-section which shows schematically a timepiece fitted with assembly elements formed by timepiece hands made in accordance with the teaching of the invention.

In the following description, identical or similar elements will be designated by the same reference numerals.

FIG. 1 shows schematically a timepiece 10 which is made in accordance with the teaching of the invention.

Timepiece 10 includes a movement 12 mounted inside a case 14 closed by a crystal 16. Movement 12 drives in rotation, about an axis A1, analogue display means formed here by an hour hand 18, a minute hand 20 and a second hand 22, these hands extending above a dial 24. Hands 18, 20, 22 are secured by being elastic gripped to coaxial cylindrical rotating arbours 26, 28, 30, in a driving in type arrangement, as will be seen hereafter.

Preferably, arbours 26, 28, 30 are conventional arbours commonly used in timepiece movements, for example metal or plastic arbours.

In the following description, we will use in a non-limiting manner, an axial orientation along rotational axis A1 of hands 18, 20, 22 and a radial orientation relative to axis A1. Moreover, elements will be termed inner or outer depending upon their radial orientation relative to axis A1.

Hands 18, 20, 22 form assembly elements, each hand 18, 20, 22 being made in a plate of brittle material, preferably a silicon based crystalline material.

Figure 2:
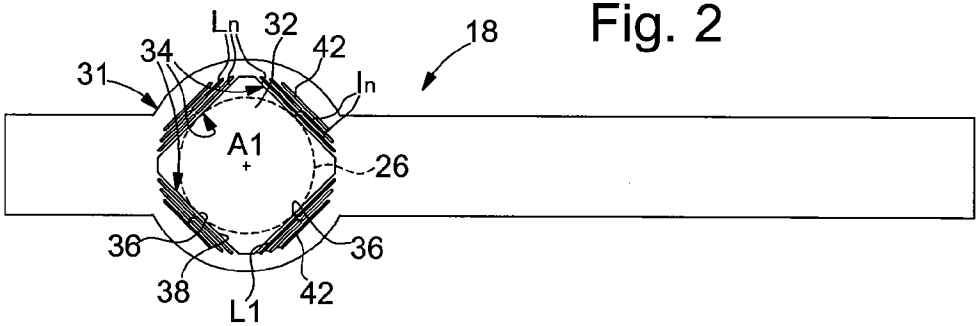
FIGS. 2 to 4 are top views that show schematically respectively the hour hand, the minute hand and the second hand fitted to the timepiece of FIG. 1 and which are provided with superposed elastic strip structures.
Figure 3:
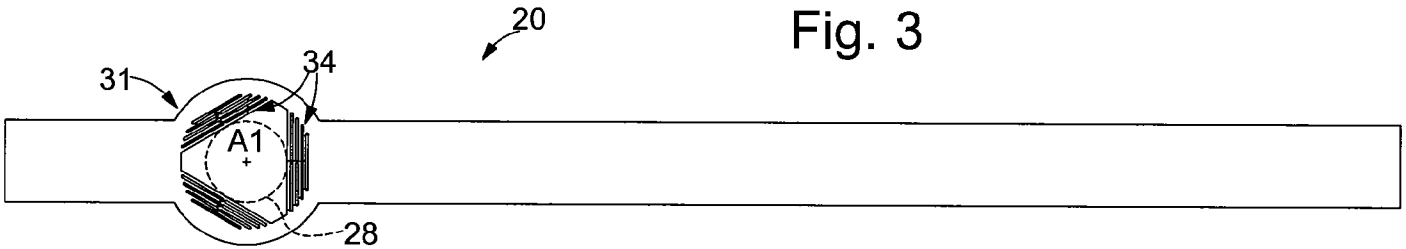
Figure 4:
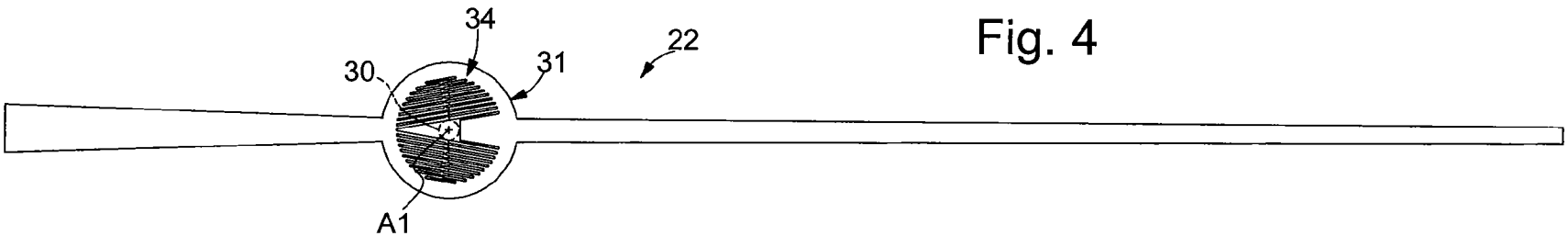

FIGS. 2, 3 and 4 show an advantageous embodiment for each of the three hands, respectively for hour hand 18, minute hand 20 and second hand 22. Each hand 18, 20, 22 includes here a mounting ring 31, which delimits an aperture 32 provided for securing the hand 18, 20, 22 to the associated arbour 26, 28, 30 by axial insertion into aperture 32. The inner wall 33 of aperture 32 includes elastic structures 34, which are etched in the plate forming mounting ring 31 and which each include at least one support surface 36 for radially gripping the associated arbour 26, 28, 30 in order to retain hand 18, 20, 22 axially and radially on arbour 26, 28, 30 and in order to secure the arbour and associated hand to each other in rotation.

A first advantageous embodiment of elastic structures 34 according to the invention will now be described by examining hour hand 18, as shown in FIG. 2 and as shown in an enlarged manner in FIG. 5. It will be noted that elastic structures 34 are shown here at rest, i.e. prior to being deformed by the insertion of the associated arbour 26, 28, 30.

Each elastic structure 34 is formed by a radial stack of several elastic rectilinear and parallel strips $L_n$ of substantially constant radial thickness, which each extend along a tangential direction relative to the associated arbour 26. The support surface 36 of each elastic structure 34 is arranged on the inner face 38 of the first elastic strip $L_1$ of the stack, on the side of arbour 26. In each elastic structure 34, each elastic strip $L_n$ is separated radially from the adjacent elastic strip $L_{n+1}$, $L_{n-1}$ by a rectilinear separator hole $I_n$ in two parts $I_{na}$, $I_{nb}$, the two parts $I_{na}$, $I_{nb}$ of separator hole $I_n$ being separated by a bridge of material $P_n$ which connects the two adjacent elastic strips $L_n$ and which is substantially aligned radially with support surface 36. The continuous series of bridges of material $P_n$ between elastic strips $L_n$ thus forms a radial connecting beam 40.

Advantageously, the end of each separator hole In has a rounded profile, for example in a semi-circle, so as to prevent an accumulation of mechanical stresses at the ends which could cause the start of cracks when elastic strips $L_n$ bend.

In the example shown, the stack forming elastic structure 34 includes three elastic strips $L_1$, $L_2$, $L_3$ and two separator holes $I_1$, $I_2$. The radial thicknesses of separator holes $I_n$ are substantially constant and identical here.

According to another feature of the invention, the last elastic strip $L_3$ of the stack, which is located on the opposite side to the first strip $L_1$, is separated radially from the rest of the plate forming hand 18 by a hole 42 in a single part, called the clearance hole 42, which defines a radial clearance space for the associated elastic structure 34. It will be noted that the minimum radial thickness of the clearance hole 42 is determined, on the one hand, by the minimum radial slot thickness allowed by the method used for etching the plate of brittle material and, on the other hand, by the maximum radial clearance of elastic structure 34. The larger of these two parameters will be selected for the minimum radial thickness of clearance hole 42. Preferably, the radial thickness of clearance hole 42 is substantially constant and greater than the radial thickness of separator holes $I_n$.

When arbour 26 is inserted into aperture 32, the effort exerted on support surface 36 causes an elastic deformation of all of elastic strips $L_n$ of elastic structure 34, such that the central part of these strips $L_n$ moves outwards radially, reducing the radial thickness of clearance hole 42 opposite beam 40. This elastic deformation generates a radial gripping force on arbour 26, similar to a driving in arrangement.

It will be noted that connecting beam 40 connects all of the elastic strips $L_n$ to each other, so that they can all be deformed simultaneously when a radial effort is applied to support surface 36, and so as to distribute the mechanical stresses at several places to minimise the risk of breakage.

Preferably, in each elastic structure 34, the length of elastic strips $L_n$ gradually decreases from the first elastic strip $L_1$ to the last elastic strip $L_3$ of the stack, which overall follows the curvature of the external cylindrical wall 44 of mounting ring 31.

Figure 5:
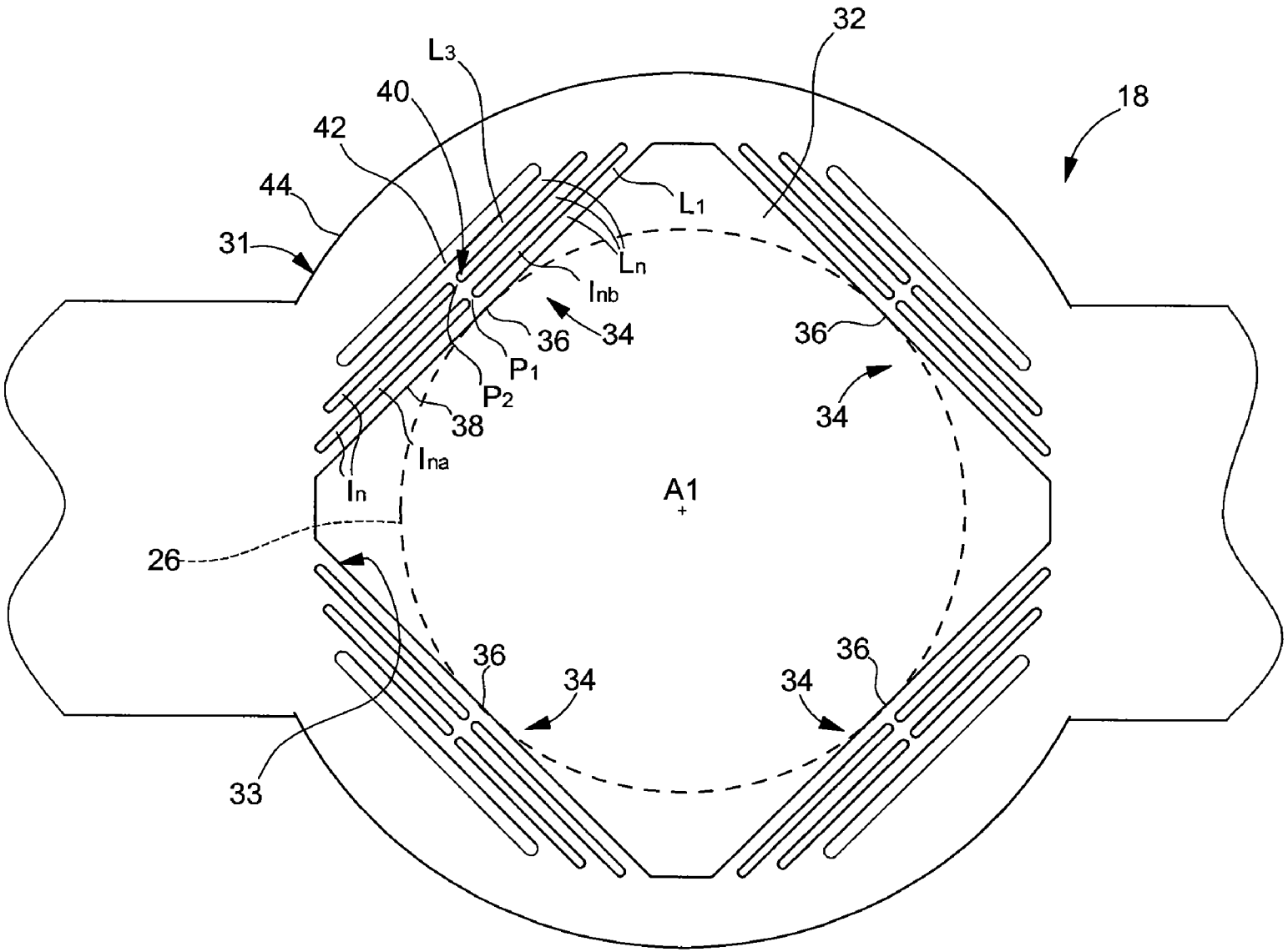
FIG. 5 is an enlarged view of one part of FIG. 2 which shows the hour hand mounting ring.

According to the embodiment shown in FIG. 5, the radial thickness of each separator hole $I_n$ is substantially constant over the entire length thereof and the radial thickness of all of the separator holes In is substantially equal.

In order to obtain maximum gripping force on arbour 26, in a given volume of material of mounting ring 31, the radial thickness of each separator hole $I_n$ is minimised.

Advantageously, for each hand 18, 20, 22, the number of elastic structures 34 arranged around aperture 32 is selected as a function of the diameter of the associated arbour 26, 28, 30 and as a function of the radial space available between inner wall 33 of aperture 32 and the outer wall 44 of mounting ring 31 of hand 18, 20, 22. Thus, the larger the diameter of arbour 26, 28, 30, and the smaller the aforementioned radial space, the larger the number of elastic structures 34.

Thus, in this embodiment, since the diameter of arbour 26 associated with hour hand 18 is much greater than the diameter of the arbour 30 associated with second hand 22, and since the external diameter of mounting ring 31 does not change proportionally, we have selected a number of elastic structures 34 equal to four for hour hand 18, whereas the number of elastic structures 34 is equal to two for second hand 22. In an intermediate fashion, the number of elastic structures 34 in minute hand 20 is equal here to three.

It will be noted that, for hour hand 18 and minute hand 20, elastic structures 34 are distributed regularly around axis A1, such that the shape of the inner contour of aperture 32 is respectively overall square and triangular.

Figure 6:
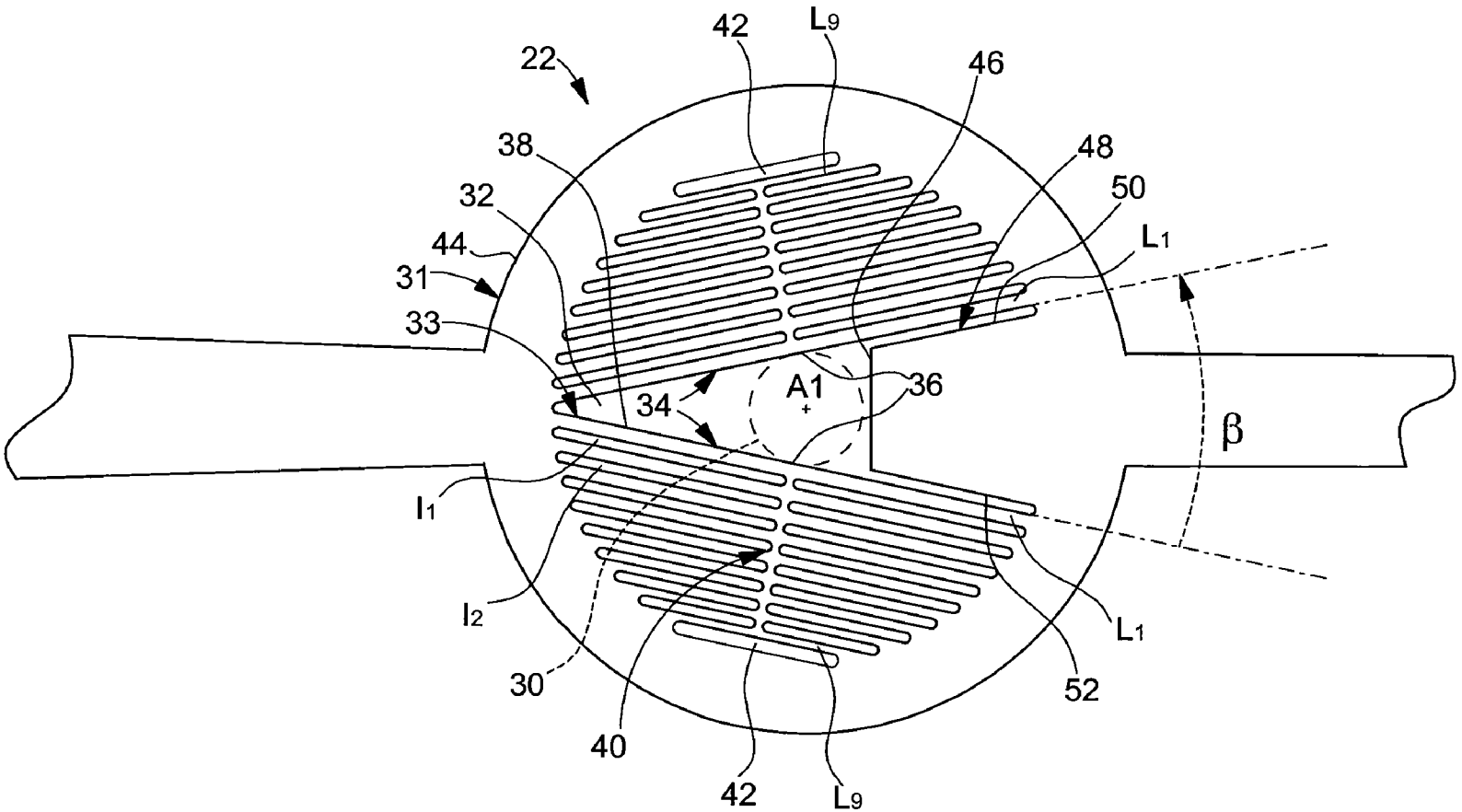
FIG. 6 is an enlarged view of one part of FIG. 4 that shows the second hand mounting ring.

We will now describe, with particular reference to FIG. 6, the specific structure of second hand 22, whose aperture 32 has only two elastic structures 34 and one fixed support surface 46. According to this embodiment, the first elastic strips $L_1$ of the two elastic structures 34 define between them an acute angle β and they are substantially joined at one of the fixed ends thereof. Angle β has, for example, a value of thirty degrees.

The fixed support surface 46 extends along a tangential direction, relative to the associated arbour 30, and it forms the base of an isosceles triangle whose two other sides are formed by the inner face 38 of the first elastic strips $L_1$ of the two elastic structures 34. The fixed support surface 46 is arranged here at the free end of an overall trapeze shaped cut out portion 48, projecting inside aperture 32. Cut out portion 48 is etched into the plate forming hand 22 and it includes here two lateral walls 50, 52, which each extend parallel to the first strip $L_1$ of the opposite elastic structure 34.

The arbour 30 associated with second hand 22 is for abutting against the fixed support surface 46 and against the support surfaces 36 of elastic structures 34.

It will be noted that the contour of the inner wall 33 of aperture 32 has the overall shape of an isosceles triangle.

According to an advantageous embodiment shown in FIG. 6, in each elastic structure 34, the radial thickness of each elastic strip $L_n$ is substantially constant over the entire length thereof, and the radial thickness of the elastic strips $L_n$ decreases gradually from the first elastic strip $L_1$ to the last elastic strip $L_g$ of the stack, each elastic structure 34 including here nine elastic strips $L_n$ of decreasing length, from the interior outwards. Thus, the radial thickness of the elastic strips $L_1$ is adapted to the length thereof, which allows substantially homogenous flexibility to be obtained for all of elastic strips $L_n$ despite their different lengths. The invention thus homogenises the mechanical stresses in the entire volume of material used for securing, i.e. here in the entire mounting ring 31.

Of course this variation in the thickness between the elastic strips $L_n$ is applicable to the other embodiments of hands 18, 20, 22.

It will be noted that the number of elastic strips forming each stack can be adapted as a function of various parameters, in particular as a function of the radial space available, as a function of the desired gripping force on the associated arbour, as a function of the type of material used for manufacturing the associated hand 18, 20, 22.

Figure 7:
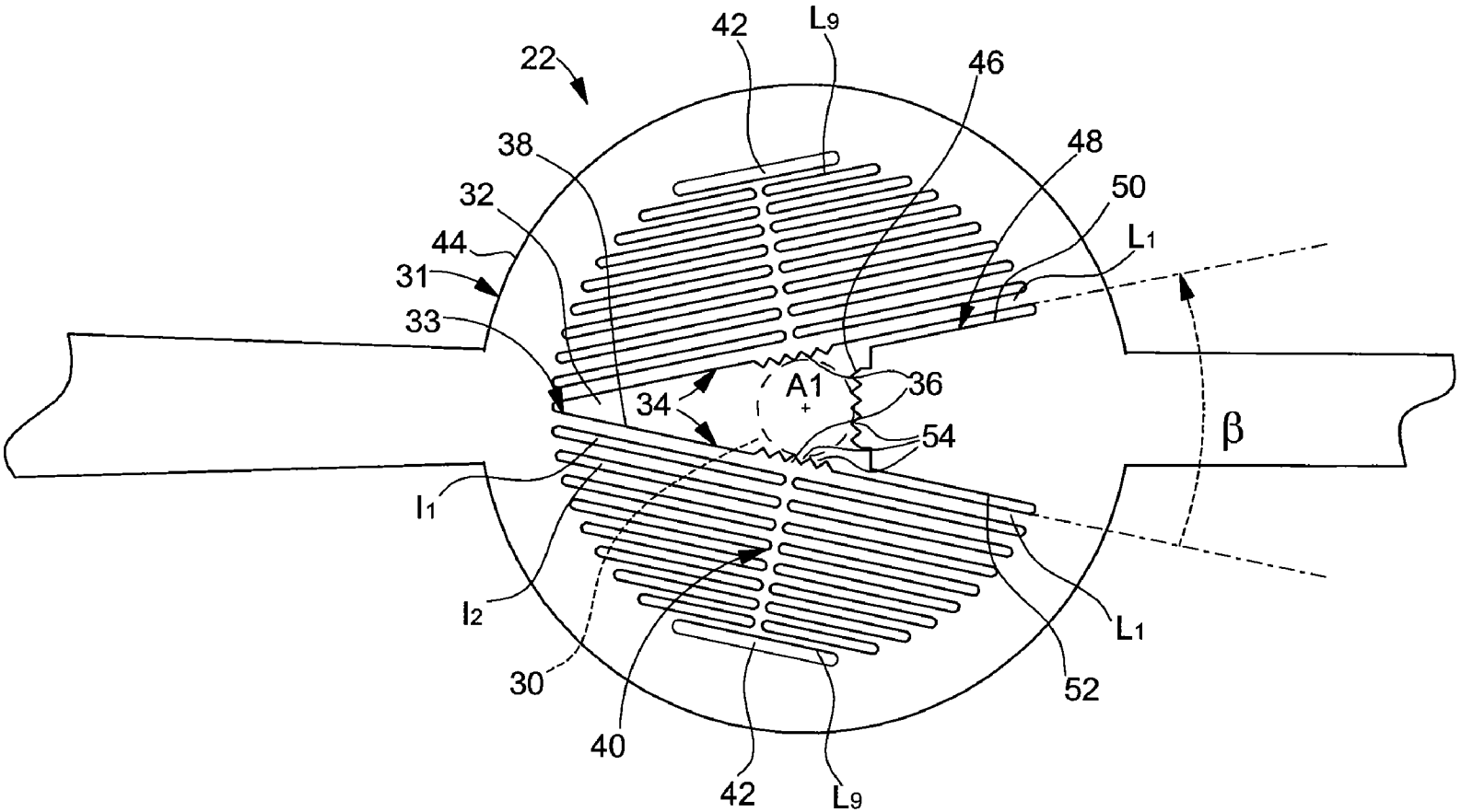
FIG. 7 is a similar view to that of FIG. 6 that shows an alternative embodiment of the elastic structures including discrete raised elements on the support surface.

FIG. 7 shows an alternative embodiment of second hand 22, which differs from the preceding embodiment in that each support surface 36, 46 is provided with discrete raised elements 54, which increase the friction between arbour 30 and support surfaces 36, 46, so as to improve the securing in rotation between arbour 30 and hand 22. Teeth of triangular profile form these discrete raised elements 54 here.

Of course, this variant is applicable to support surfaces 36 arranged in apertures 32 of hour hand 18 and minute hand 20 described with reference to FIGS. 2 and 3.

Although the present invention has been described with respect to assembly elements formed by hands 18, 20, 22, it is not limited to these embodiments. Thus, the assembly element could be formed by another type of rotating element, for example by a toothed wheel used in a timepiece movement. The assembly element could also be formed by a non-rotating element, for example a plate of brittle material provided for assembly on another element including a securing arbour, or stud, made of metal.

The present invention is applicable to a hand 18, 20, 22 made in a silicon plate comprising a single layer of silicon, and in a SOI (silicon on insulator) type silicon plate which comprises a top layer and a bottom layer of silicon separated by an intermediate layer of silicon oxide.

What is claimed is:

1. An assembly element made in a plate of brittle material such as a silicon, particularly for a timepiece, including an aperture provided for the axial insertion of an arbour, the inner wall of the aperture including elastic structures which are etched into the plate and which each include at least one support surface for gripping the arbour radially in order to secure the assembly element relative to the arbour, wherein each elastic structure includes a first rectilinear elastic strip which extends along a tangential direction relative to the arbour, the support surface being arranged on the inner face of the first elastic strip, wherein each elastic structure is formed by a radial stack of several parallel elastic strips, each elastic strip being separated radially from the adjacent elastic strip by a rectilinear separator hole in two parts, the two parts of the separator hole being separated by a bridge of material which connects the two adjacent elastic strips and which is substantially aligned radially with the support surface, and wherein the last elastic strip of the stack, which is located on the opposite side to the first strip is separated radially from the rest of the plate by a hole in a single part, called the clearance hole, which defines a radial clearance space for the elastic structure.

2. The assembly element according to claim 1, wherein in each elastic structure, the length of the elastic strips decreases gradually from the first elastic strip to the last elastic strip of the stack.

3. The assembly element according to claim 2, wherein the radial thickness of each elastic strip is substantially constant over the entire length thereof, and wherein, in each elastic structure, the radial thickness of the elastic strips decreases gradually from the first elastic strip to the last elastic strip of the stack.

4. The assembly element according to claim 3, wherein the radial thickness of the separator holes is substantially constant for each separator hole and substantially constant from one separator hole to the next.

5. The assembly element according to claim 4, wherein the minimum radial thickness of the clearance hole is greater than or equal to the radial thickness of the separator holes.

6. The assembly element according to claim 1, wherein the profile of each of the ends of the each separator hole is rounded.

7. The assembly element according to claim 1, wherein the support surface of the first elastic strip includes discrete raised elements which increase the friction between the arbour and the support surface.

8. The assembly element according to claim 1, wherein the inner wall of the aperture includes at least three elastic structures which are regularly distributed around the arbour.

9. The assembly element according to claim 4, wherein the inner wall of the aperture is formed by two elastic structures and by one fixed support surface, wherein the first elastic strips of the two elastic structures define between them a determined angle, and wherein the first elastic strip of the two elastic structures are joined at one of the fixed ends thereof.

10. The assembly element according to claim 1, wherein the contour of the inner wall of the aperture has the overall shape of an isosceles triangle, and wherein the fixed support surface constitutes the base of the isosceles triangle.

11. The assembly element according to claim 1, wherein the fixed support surface is arranged at the free end of a cut out portion projecting inside the aperture.

12. Assembly element according to claim 1, wherein it is formed by a rotating element that is fixedly mounted in rotation to the arbour.

13. The assembly element according to claim 12, wherein it is formed by a timepiece hand.

14. The timepiece wherein it includes an assembly element according to claim 1.

* * * * *